United States Patent [19]

Griffioen

[11] Patent Number: 4,504,375

[45] Date of Patent: Mar. 12, 1985

[54] ANODE ELEMENT FOR USE IN A CATHODIC PROTECTION SYSTEM

[75] Inventor: Geurt Griffioen, Lienden, Netherlands

[73] Assignee: Hommema Van 1825 B.V., Duurstede, Netherlands

[21] Appl. No.: 573,877

[22] Filed: Jan. 25, 1984

[30] Foreign Application Priority Data

Jan. 31, 1983 [NL] Netherlands ..... 8300352

[51] Int. Cl.[3] ..... C23F 13/00

[52] U.S. Cl. ..... 204/196; 204/280; 204/289

[58] Field of Search ..... 204/147, 148, 196, 197, 204/280, 289

[56] References Cited

U.S. PATENT DOCUMENTS

| | | | |
|---|---|---|---|
| 1,608,709 | 11/1926 | Mills | 204/197 |
| 2,053,214 | 9/1936 | Brown | 204/196 |
| 3,071,531 | 1/1963 | Hosford | 204/196 |
| 3,391,072 | 7/1968 | Pearson | 204/197 |
| 3,523,884 | 8/1970 | Bagno | 204/196 |
| 3,725,669 | 4/1973 | Tatum | 204/196 |
| 4,268,371 | 5/1981 | Brun et al. | 204/196 |

FOREIGN PATENT DOCUMENTS

| | | | |
|---|---|---|---|
| 2207061 | 8/1972 | Fed. Rep. of Germany | 204/196 |
| 0852969 | 8/1981 | U.S.S.R. | 204/196 |

*Primary Examiner*—T. Tung

*Attorney, Agent, or Firm*—Fiddler & levine

[57] ABSTRACT

An anode element for use in a cathodic protection system comprises a tube 1 having a pointed front extremity 2 and a rear extremity 3 adapted to be acted upon by an impact force. The tube 1 is filled with a granular carbon-containing material 18 having a metal rod provided therein. Connected to the rod 4 is an electrical connecting cable 10 which, via a passage 14 provided in the wall of the tube 1, extends to the outside of the tube 1 through a pipe 13 provided on the outer wall of the tube 1, said pipe 13 having a diameter smaller than that of the tube and extending parallel to the center line of the tube 1 from the passage 14 to the rear extremity 3 of said tube.

8 Claims, 1 Drawing Figure

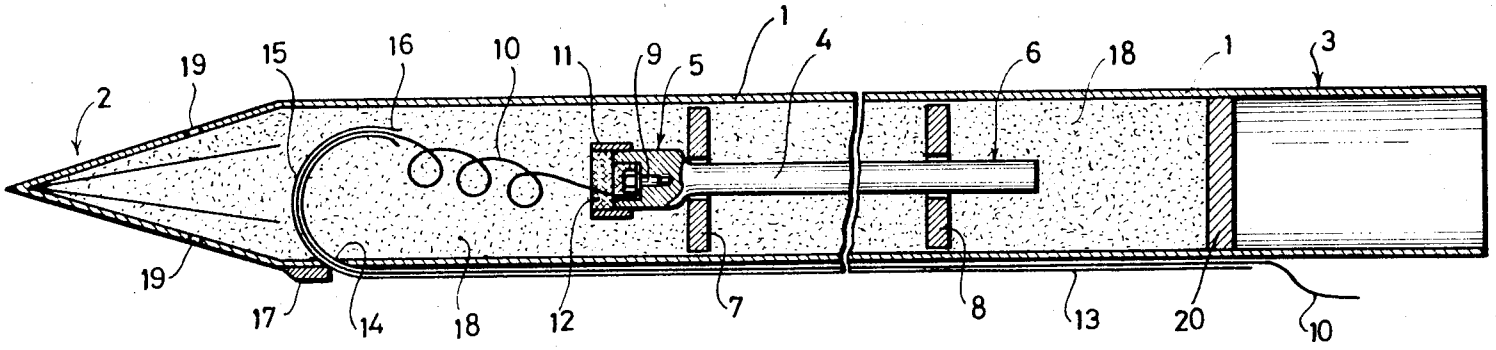
3
1
18
6
4
1
5
9
11
10
16
15
19
2
10
20
13
8
7
12
18
14
17
19

ANODE ELEMENT FOR USE IN A CATHODIC PROTECTION SYSTEM

BACKGROUND OF THE INVENTION

The present invention relates to an anode element for use in a cathodic protection system and provided with a metal tube, the one extremity of which is pointed and the other extremity of which is adapted to be acted upon by an impactor, an electrically conductive rod disposed within the tube aligned with the center line of the tube and spaced from the tube wall and having a length smaller than the tube, a connecting cable connected to the rod and extending to the outside of the tube via a passage provided in the tube wall, and a quantity of granular carbon-containing filling material within the tube, the filling material being in contact with the rod and with the tube wall, which filling material can be kept within the tube by means of a disk-shaped sealing provided at the other extremity of the tube.

An anode element of this type is known from U.S. Pat. No. 2,053,214 issued to R. C. BROWN, on Sept. 1, 1936. In said known anode element, the rod preferably consists of pressed graphite, and in the vicinity of the other, dull extremity of the tube the end of the rod and an end of the connecting cable are enclosed in the disk-shaped sealing which is supported all around against the inner wall of the tube, the sealing being gas-impermeable and consisting of carbon and asphalt or any other suitable mastic material. The rod may also consist of copper or steel with a covering of granular silicon carbide or zirconium. Such a form of construction of the known anode element using a porous filling and a porous surface of the rod is aimed to extend the disintegration time of, in particular, the rod.

A heavy metal drive cap, for example of wrought iron, is placed over the dull extremity of the tube. The connecting cable is routed to the outside of the tube via aligned passages which are formed in the tube wall of the dull extremity of the tube and in the cap flange extending over this extremity.

This known anode element has the drawback that it is not sufficiently adapted to be driven into the ground completely. During the driving operation, the cap provided on the dull extremity of the tube would cause an undesirable, great resistance with the surrounding earth, while the connecting cable may be damaged by the surrounding earth during said driving operation, particularly so if the ground would contain hard objects with sharp edges, such as pieces of rock. For similar reasons, the known anode element is not suitable as a succeeding element to be driven into a shaft already present, as a result of an anode element previously driven into the ground. The connecting cable of each anode element previously driven in, will then almost certainly be damaged by each anode element subsequently driven into the same shaft.

In order to obtain a greater current density of the core or rod provided within the tube and to extend the useful life of the anode element during its use within the ground, nowadays a rod is preferred consisting of another material, for instance silicon iron, which in addition can be easily cast into a desired form and subsequently machined. However, a rod formed from such a material having initial dimensions corresponding to a desired current density and lifetime thereof is relatively heavy with respect to the rod used in the known anode element. The disk-shaped sealing member used in the dull extremity ensuring a mechanical and electrical connection between the connecting cable, the rod and the inner wall of the tube is, therefor, not sufficiently suited to accommodate therein an end of a relatively heavy rod. If driving the anode element would take place by means of an impactor, which would be desirable for deep penetration, there would be the danger of breaking the mechanical and/or electrical connection.

Although a rod of silicon iron is less brittle than a rod of graphite, there would, when using a rod of silicon iron in the known anode element, still be the danger of the rod breaking during impacting, thus resulting in a smaller efficiency and shorter useful lifetime. This is due to the fact that in the case of the known anode element the rod is connected relatively rigidly to the tube by means of the disk-shaped sealing member. The danger of cracking or breaking is then greater to the extent that a greater force of impact is to be exerted upon the dull tube extremity, for example, when driving the element into the ground over a relatively large distance and/or when the earth is rocky and/or the anode element would be adapted to be driven in conjunction with several others in a line.

German Pat. No. 2,207,061 issued to DALE, OLAV TUMBA, on Aug. 31, 1972, discloses an anode element consisting of a tube having a pointed extremity in which there is centrally disposed a rod, for example of copper, extending from the one extremity to the other extremity. In the tube point area, the rod is centered in a plastic centering piece, and at the dull extremity of the tube the rod is contained in a disk-shaped sealing of insulating, hardened material. The filling material provided within the tube consists of a hardened mixture of for instance 50% epoxy resin and 50% graphite powder. The connecting cable connected to the rod in the disk-shaped sealing member is routed aligned with the rod out of the dull extremity of the tube. To afford driving this known anode element into the ground by means of an impactor, an adaptor is placed over the dull extremity of the tube, the adaptor being provided in longitudinal direction with a slot for cable passage. In order to protect the cable over the entire shaft length above the anode element, while the latter is being driven, the adaptor length should be at least equal to the length of the portion of the shaft which is attained when the anode element reaches its final position. Consequently, driving the anode element into the ground over a large distance requires an adaptor having an impractical length. Said known anode element is not suitable either to be placed, possibly using the adaptor, after an anode element previously placed into the same shaft, because in such event the connecting cable of each previously placed anode element is almost certain to be damaged while a subsequent anode element is being driven in. Since the entire anode element mainly consists of undeformable, mutually immovable material, the known anode element is not suitable either for a rod to be used which consists of relatively brittle material, such as silicon iron. For, during the driving of the anode element, the rod could crack, as a result of which the efficiency and useful lifetime of the element would be reduced.

In addition, each of the known anode elements described hereinbefore has the drawback that the disk-shaped sealing member consists of a material that is gas-impermeable, which impedes proper functioning of the anode element.

SUMMARY OF THE INVENTION

It is a main object of the present invention to eliminate the drawbacks cited hereinbefore.

The anode element according to this invention differs in particular from the known anode elements first described, in that the rod is disposed within the filling material in a somewhat axially movable manner, while during the displacement of said rod the connecting cable in the vicinity of the connection thereof with the rod, is capable of moving. The outer wall of the tube including the extremeties is substantially smooth in an axial direction and is provided with a pipe having a smaller diameter than that of the tube, said pipe extending parallel to the center line of the tube from the passage to the other extremity of the tube, the connecting cable extending outside the tube from the passage through the pipe.

Since the rod is not rigidly joined to the tube during the driving of the anode element, it is capable of displacement within the granular filling material together with the cable connection part, as a result of the mass inertia of the rod. Thus, rod crack formation is prevented to a large extent.

The pipe having a relatively small diameter which is provided on the outer wall of the tube and through which extends the connecting cable forms, during the driving of the anode element into the ground, a groove in which the cable can be led during impacting. As, in addition, the rear extremity of the tube is substantially smooth, damage to the connecting cable caused during the driving of the anode element is reduced to a minimum. While the anode element is being driven into the ground in vertical direction, it may be necessary to keep the connecting cable taut in the groove so formed. The anode element according to the present invention, however, is also adapted to be driven into the ground in any other direction. From the beginning of the driving operation, it is then preferred to position the tube rotationally in such a manner that the connecting cable cannot slip out of the groove formed during the driving operation. This also exhibits the advantage of the anode element according to the invention to the effect that it is adapted to be driven after an anode element previously placed into the same shaft in any arbitrary direction. By turning the successive tubes over a certain angle relative to one another, the respective connecting cables can then be led in their own groove, thus substantially preventing them from being damaged.

The anode element of the invention, therefore, is extremely adapted to be installed into the ground in any position desired, via a shaft running in any direction desired, for example, via horizontally running shafts reaching underneath storage tanks which may have a diameter of 60 m, and, for instance, via shafts running horizontally under hardened ground coverings, such as concrete parking areas.

The end of the pipe attached to the outer wall of the tube could be somewhat curved toward the passage means and possibly be deflected to a point within said passage means. In order to obtain the groove to be formed with the pipe during the driving operation with less resistance, however, and to prevent as much as possible the pipe from being damaged at the passage means, it is preferred that between the passage and the one extremity of the tube on the outer wall of the tube, there is provided a protrusion whose section increases gradually from the one extremity until reaching approximately the cross-section of the pipe.

Preferably, the anode element is such that the pipe extends through the passage to the interior of the tube, and the portion within the tube is gradually deflected in the direction of the point of connection of the connecting cable to the rod. This affords leading the connecting cable, in a simple manner by using a pulling cable, from the outside of the tube into the pipe and from there into the interior of the tube and then again to the outside of the tube, as a result of which the connecting cable can be easily fastened to the rod and subsequently, after the tube has been partially filled with the filling material, can be brought back into the position as desired, within the tube. The part of the cable at the point of connection thereof to the rod can easily move along with the rod while the anode element is being driven, if the connecting cable tracks a curved path in the vicinity of the point of connection of the connecting cable to the rod.

Although the rod should be capable of displacement within the filling material over a relatively short distance, it is desirable that the maximum displacement distance arising as a result of the relatively heavy weight of the rod is limited. This object is attained according to the invention in that within the tube there are provided one or several disks extending radially with respect to the center line of the tube, each being provided with an opening through which the rod is fitted, the rod being provided with a thickened portion resting against one of the disks on the side of the one extremity of the tube.

The anode element of the invention is well resistant to the shocks produced during the driving with an impactor, so that, in other words, it is adapted to be driven into the ground simultaneously with several other anode elements. To this end, the anode element of the present invention is preferably formed such, that a space is provided within the tube between the edge of the other extremity thereof and the filling material, said space being adapted for receiving therein the pointed extremity of the tube of another anode element. Said space is also suitable for receiving therein the somewhat point-shaped extremity of a ram cylinder, also often referred to as ground rocket, which is preferably to be used for the driving operation and which advances itself within the shaft in a pulsating manner as controlled via flexible pressure tubes.

Actually, the disk-shaped sealing member is to be present only when the anode element is in transit on its way to the location where it is to be driven into the ground, so as to prevent the filling material from pouring out of the tube. If the disk is not gas-permeable, it is to be removed subsequently out of the tube in order to ensure proper functioning of the anode element. However, the disk-shaped sealing member can also be such that it is gas-permeable, so that it can be left in place within the tube from the moment of manufacture of the anode element.

In order to be able to fix the rod within the tube in a sufficiently supported relationship in axial direction, it is preferred to supply the filling material in a weak aqueous solution within the tube during the anode-element manufacturing process, and to have, thereupon and/or during the filling operation, the water drain off through openings formed in the pointed extremity of the tube. There will then occur suitable thickening of the filling material. After placing the anode element into the ground in the position as desired, the same openings will allow groundwater to flow into the tube, thus enhancing proper functioning of the anode element as a result of electrolytic action.

SURVEY OF THE DRAWING

The drawing is a sectional view of an embodiment of the anode element according to the present invention.

DESCRIPTION OF THE PREFERRED EMBODIMENTS

The anode element comprises a preferably seamless metal tube 1 having a pointed or spherical front extremity 2 and a rear extremity 3. Within the tube 1 there is disposed along the axis of symmetry thereof a metal anode rod 4 having a front end 5 and a rear end 6. The front end 5 has a larger section than the remainder of the rod 4. Between the ends 5,6 of the rod 4 there are provided two centering rings 7, 8 of insulating material, the opening of the ring 7 being smaller than the section of the thick front end 5 of the rod 4. An insulated cable 10 is electrically connected to the front end 5 of the rod 4 for instance by means of a screw 9. As can be seen, the head of the screw 9 and the electrical connection part of the cable 10 may be recessed within the thick front end 5 of the rod 4. After connecting the cable 10 to the rod 4, a ring 11 is fitted around the front end 5, whereupon the space bounded by the ring 11 and the front end 5, is filled with insulating material 12, such as epoxy resin.

On the outer wall of tube 1, there is provided, parallel to the axis of the tube 1, a straight pipe 13 having a relatively small diameter. In the vicinity of the front extremity 2 the pipe 13 has a U-bend 15 led through a passage 14 provided in the tube 1 and preferably having a flaring end 16. The connecting cable 10 is routed from the point of connection to the rod 4 via the pipe 13 to the outside of the pipe 13. The inner diameter of the pipe 13 is just a little larger than the diameter of the cable 10.

In close proximity to the passage 14, on the outer wall of the tube 1, along the axis of pipe 13, a protrusion 17 has been formed whose section increases gradually from the front extremity 2 of the tube 1 in the direction of the passage 14 until reaching preferably at least the cross-section of pipe 13.

The space within the tube 1 is filled with granular coke material 18 whose average grain size may be approximately 1 cm and which is thickened during the manufacture of the anode element as water is being supplied via the rear extremity 3 of the tube 1. During the manufacture of the anode element, the tube 1 is vertically positioned with the pointed or spherical front extremity 2 directed downwardly and the water being supplied is discharged via several small openings 19 provided in the front extremity 2.

The tube 1 filled with coke 18 is preferably closed off by means of a disk 20 which is impervious to the coke 18, so that when the tube 1 is in transit no coke 18 can pour out of the tube 1. If the disk 20 is gas-impermeable, it must be removed from the tube directly, prior to bringing the anode element into the ground. However, the disk 20 can also be composed of a porous gas-permeable material, so that there is no need for subsequent removal once installed within the tube 1, so that in this case the gas being developed during operation in the vicinity of the anode rod 4 can leave the tube 1 via the coke material 18 and the disk 20.

The cable 10 is very much slackened, for instance, by means of a number of loops in the area between the point of connection thereof to the rod 4 and the end 16 of the pipe 13.

The anode element as shown in the FIGURE is adapted to be lowered at a cable into a shaft previously drilled or jetted into the ground. The anode element is also suitable to be pushed forwardly into a horizontal or inclined, rising shaft previously formed.

However, the anode element as shown is particularly intended to be suitable to be driven into the ground in any desired direction by means of an impactor acting upon the rear extremity 3 of the tube 1, i.e. without prior forming of a shaft into the ground for the passage of the anode element. The impactor may consist of a pile driver, but particularly consists of a ram cylinder (often called ground rocket), known per se, which has an identical or slightly larger cross-section than the cross-section of the tube 1 and which, placed behind the tube 1, exerts a pulsating force upon the tube 1 and moves itself through the shaft which is formed by the forwardly driven tube 1. Since, as described, the opening of the ring 7 is smaller than the section of the widened front end 5 of the anode rod 4, the displacement of the rod 4 in the direction of the rear extremity 3 of the tube 1, which occurs as a result of the mass inertia of the rod 4, during impactor operation, is limited because the ring 7 is made to move along, which corresponds to a greater displacement resistance.

Since the connecting cable 10 is not connected to the rear end 6 of the anode rod 4 and from there directly to the rear extremity 3 of the tube 1, but instead is connected to the front end 5 of the anode rod 4, and since, in the area between this point of connection and the end 16 of the pipe 13, the cable is slackened, damage to said point of connection, in particular damage to the insulation, which could cause rapid corrosion of the metal cable core, as well as rupture of the cable 10 due to the operation of an impactor acting upon the tube 1, are prevented.

The protrusion 17 serves to protect the pipe 13, which is generally thin-walled, against damage, for instance caused by rocks, while the anode element is being driven into the ground.

In bringing the anode element into the ground, the protrusion 17 and the pipe 13 will form a groove into the shaft formed by the tube 1, so that, by keeping the cable 10 of an anode element previously placed taut into the groove formed by this anode element, it is possible to place another anode element behind the anode element previously placed, without the possibility of damage being caused by the last anode element to the connecting cables.

In a practical embodiment of the anode element according to the invention, the tube 1 is a seamless steel tube having a total length of 2 m, a cross-section of 127.5 mm, and a thickness of 4 mm, the pointed or spherical front extremity 2 having a length of approximately 200 mm. The anode rod 4 consists of silicon cast iron (SiFe), and has a length of 1 m, and is disposed symmetrically in the center of the tube 1. After bringing the anode element into the ground, the steel tube 1 will disintegrate after several years, due to corrosion depending on the current density, which, however, does not impair proper functioning of the anode element.

As shown in the figure, the rear extremity 3 of the tube 1 has a space between the disk member 20 and the end edge of the tube 1 at the rear extremity 3, whose dimensions are adapted for receiving therein the pointed extremity 2 of another tube 1, so that several tubes 1 can be inserted into one another and be simultaneously driven into the ground by the impactor in any direction as desired. In such case, proper attention should be paid to ensure that the respective pipes 13 of the tubes 1, and so likewise the groove formed by the pipes 13 into the ground with the corresponding connecting cables 10 therein, are turned over an angle with respect to each other. In spite of the fact that the impact force required will be greater than that needed for driving a single anode element into the ground, the chances of any rod 4 or any cable 10 being damaged are nevertheless small, thanks to the particular features of the anode element according to the invention.

After each tube 1 has been brought into its proper position, or even while the tube is being driven into the ground, groundwater can penetrate into the tube 1 via the openings 19 formed in the pointed extremity 2, thus resulting in a better performance of the anode element.

What is claimed is:

1. An anode element for use in a cathodic protection system and provided with a metal tube, the one extremity of which is pointed and the other extremity of which is adapted to be acted upon by an impactor, an electrically conductive rod disposed within the tube aligned with the center line of the tube and spaced from the tube wall and having a length smaller than the tube, a connecting cable connected to the rod and extending to the outside of the tube via a passage provided in the tube wall, and a quantity of granular carbon-containing filling material within the tube, the filling material being in contact with the rod and with the tube wall, which filling material can be kept within the tube by means of a disk-shaped sealing provided at the other extremity of the tube, wherein the rod is disposed within the filling material in a somewhat axially movable manner, while during the displacement of said rod the connecting cable in the vicinity of the connection thereof with the rod is capable of moving along, and the outer wall of the tube including the extrimities is substantially smooth in an axial direction, said outer wall of the tube being provided with a pipe having a smaller diameter than that of the tube, said pipe extending parallel to the center line of the tube from the passage to the other extremity of the tube, the connecting cable extending outside the tube from the passage through the pipe.

2. An anode element according to claim 1, wherein between the passage and the one extremity of the tube on the outer wall of the tube, there is provided a protrusion whose section increases gradually from the one extremity until reaching approximately the cross-section of the pipe.

3. An anode element according to claim 1, wherein the pipe extends through the passage to the interior of the tube, and the portion of the pipe within the tube is gradually deflected in the direction of the point of connection of the connecting cable to the rod.

4. An anode element according to claim 3, wherein the connecting cable tracks a curved path in the vicinity of the point of connection of the connecting cable to the rod.

5. An anode element according to claim 1, wherein within the tube there are provided one or several disks extending radially with respect to the center line of the tube each being provided with an opening through which the rod is fitted, the rod being provided with a thickened portion resting against one of the disks on the side of the one extremity of the tube.

6. An anode element according to claim 1, wherein a space is provided within the tube between the edge of the other extremity thereof and the filling material, said space being adapted for receiving therein the pointed extremity of the tube of another anode element.

7. An anode element according to claim 1, wherein the disk-shaped sealing member is gas-permeable.

8. An anode element according to claim 1, wherein the tube is provided, in the vicinity of the one extremity thereof with several openings having diameters chosen such, that they substantially impede the passage of filling material therethrough.

* * * * *